United States Patent [19]

Sieck

[11] Patent Number: 4,488,402

[45] Date of Patent: Dec. 18, 1984

[54] INTERNAL THERMAL EXCHANGER ENGINE

[76] Inventor: Charles A. Sieck, Riverhouse Apts. 2311 N. Front St., Harrisburg, Pa. 17110

[21] Appl. No.: 375,172

[22] Filed: May 5, 1982

[51] Int. Cl.[3] ..... F02G 1/04

[52] U.S. Cl. ..... 60/517; 60/682; 60/526

[58] Field of Search ..... 60/516, 517, 525, 526, 60/650, 682

[56] References Cited

U.S. PATENT DOCUMENTS 2,680,352 6/1954 McMahon ..... 417/901 X 3,218,815 11/1965 Chellis et al. ..... 62/6

3,717,004 2/1973 O'Neil ..... 62/6

*Primary Examiner*—Allen M. Ostrager

*Attorney, Agent, or Firm*—LeBlanc, Nolan, Shur & Nies

[57] ABSTRACT

An internal thermal exchanger engine which, in one embodiment, includes an enclosed cylindrical chamber having hot and cold end portions and containing an open ended heat exchanger provided with heat conductive materials such as fine copper wire strands which function in heat exchange relationship with a gas contained within the chamber. In an alternative embodiment, the enclosed chamber is in the form of a semi-cylinder, with the heat exchanger being of a wedge shape construction and being freely rotatable between a hot side of the semi-cylinder and a cold side across the arc of the semi-cylinder.

14 Claims, 5 Drawing Figures

FIG. 1
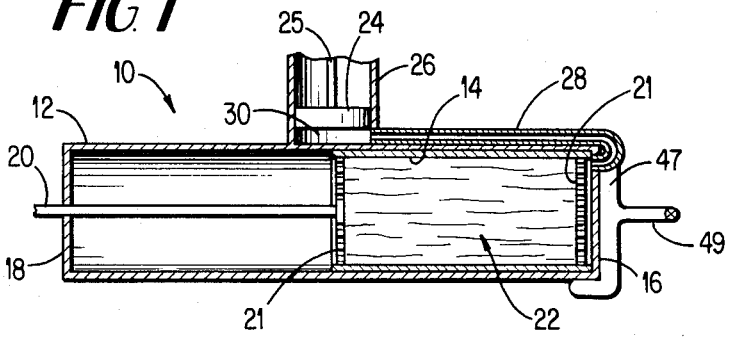
FIG. 2
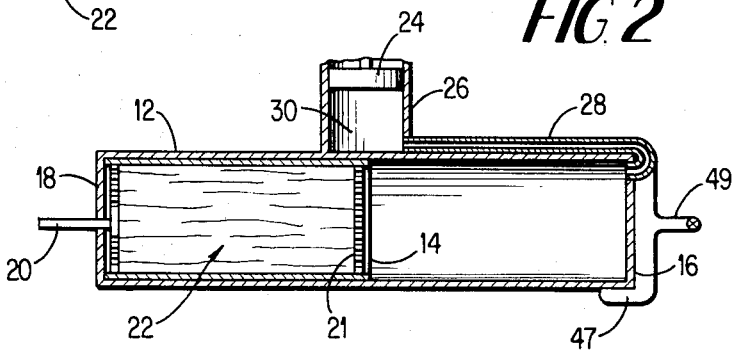
FIG. 3
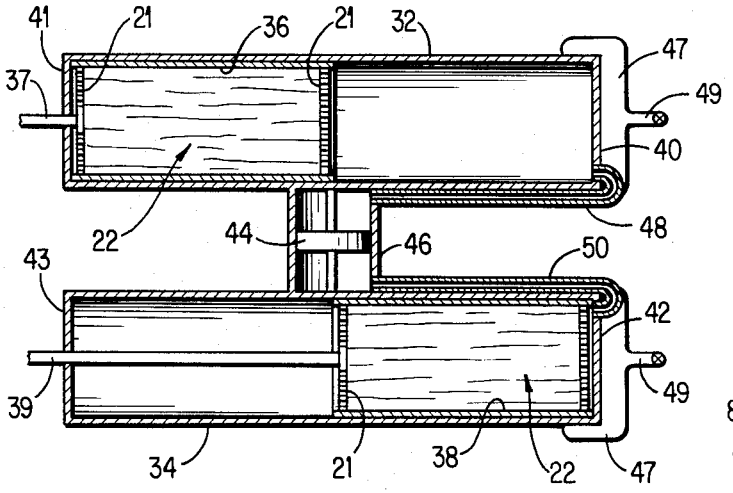
FIG. 5
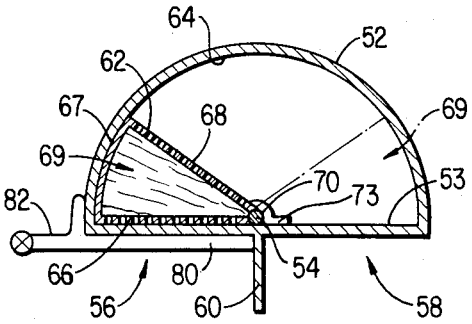
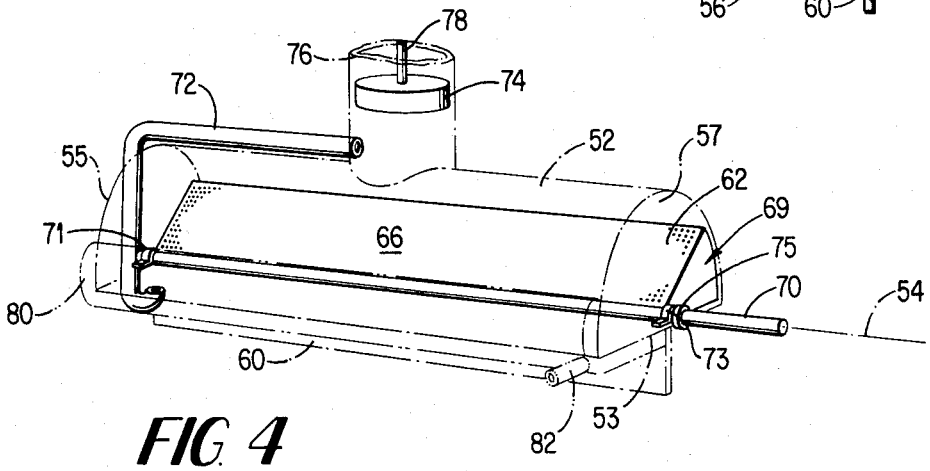
FIG. 4

INTERNAL THERMAL EXCHANGER ENGINE

BACKGROUND AND SUMMARY OF THE INVENTION

The present invention relates to a heat engine construction. More particularly, the present invention relates to an engine construction including a heat exchanger which is movable between two extreme positions within an enclosed space, and which produces a variation in pressure which may be transmitted to a working piston.

Various types of engines are known which are employed to operate as heat engines, with such engines being described, for example, in U.S. Pat. No. 3,956,894 to Tibbs; U.S. Pat. No. 3,878,680 to Dauvergne; U.S. Pat. No. 4,077,221 to Maeda; and U.S. Pat. No. 4,270,351 to Kuhns.

By the present invention, there is provided an internal thermal exchanger engine which, in one embodiment, includes an enclosed shell or chamber having hot and cold end portions and having contained therein a heat exchanger which occupies approximately one-half the total volume of the chamber, the heat exchanger being open ended and containing heat conductive materials such as fine copper wire strands which function in heat exchange relationship with a gas contained in the chamber. In an alternative embodiment of the invention, the enclosed chamber is in the form of a semi-cylinder, with the heat exchanger of a wedge-shape construction and being freely rotatable between a hot side of the semi-cylinder and a cold side across the arc of the semi-cylinder.

In the present heat engine, the pressure differential is achieved in a most efficient way due to the action of the internal heat exchanger which removes energy from the gas as the exchanger moves from cold to hot end locations, storing such energy within the system in the exchanger material, creating low pressure in the chamber and then releasing energy to the gas to create high pressure in the chamber as the exchanger moves from the hot to the cold end locations within the chamber.

It is an object of the present invention to provide a thermal engine which is capable of highly efficient operation.

It is a further object of the invention to utilize to the fullest extent the energy supplied during operation of a heat engine.

It is another object of the invention to provide a thermal engine which operates within an enclosed space to produce a pressure differential which may be transmitted to a location outside the enclosed space.

It is another object of the invention to re-cycle heat energy within the heat engine system by the use of an internal heat exchanger.

It is another object of the invention to provide a system which removes energy from a gas contained within an enclosed chamber and which transfers this energy to a working piston.

BRIEF DESCRIPTION OF THE DRAWINGS

The objects and advantages of the internal thermal exchanger engine of the present invention will be more clearly understood from the following description of the prefered embodiments, taken in conjunction with the accompanying drawings wherein:

FIG. 1 is a diagrammatic representation of a single cylinder embodiment of the engine of the present invention;

FIG. 2 is a diagrammatic representation of the engine of FIG. 1, with the heat exchanger shown at the opposite end location;

FIG. 3 is a diagrammatic representation of a double cylinder embodiment of the engine of the present invention;

FIG. 4 is a diagrammatic prespective view of a semi-cylinder embodiment of the engine of the present invention; and FIG. 5 is a diagrammatic representation of an end view of the engine of FIG. 4, with the heat exchanger shown as rotated to the opposite extreme position from that of FIG. 4.

DESCRIPTION OF THE PREFERRED EMBODIMENTS

In the embodiment of the present invention as shown in FIGS. 1 and 2, there is provided a thermal engine 10, including enclosed cylindrical chamber 12 and cylindrical heat exchanger 14 contained internally within the chamber 12. The chamber 12 is constructed of a heat conductive material, preferably a non-ferrous metal, being closed at the ends 16,18 and containing gas either at atmospheric pressure or pressurized. One end 16 of the chamber 12 is maintained at a high temperature such as about 1100° F. on the external portion thereof by means of a heat source 47 while the other end 18 of the chamber 12 is at ambient temperature, for example, about 70° F., on the external portion.

The heat exchanger unit 14 is also of cylindrical shape, fitting inside the chamber 12 with a close tolerance so that the outer walls of the exchanger 14 slide freely within the interior walls of the chamber 12. The heat exchanger 14 is open-ended and, in one embodiment, is of a length equal to approximately one-half the length of the chamber 12. The heat exchanger 14 is thus free to move from one end 16 to the other 18 of chamber 12.

The exchanger 14 is constructed of a heat conductive material and is filled with a material 22 which functions in heat exchange relationship with the gas contained in the chamber 12. The material 22 should be of a foraminous nature, i.e., having small openings therein to allow the gas within the system to pass through the exchanger 14. In a specific embodiment, the material 22 employed was copper wire screening, of a size of approximately 1/32 inch in diameter. In general, the diameter of the wire or other such material would depend on the size of the chamber and the desired speed of oscillation of the heat exchanger. Such screening may be employed in horizontal strips or vertical layers which effectively fill the volume of the heat exchanger 14 while allowing gas to pass freely through the exchanger 14 as the exchanger 14 moves from one end of the chamber 12 to the other.

A working piston 24 operating within a cylinder 26 is located adjacent the chamber 12, with the cylinder 26 being in fluid communication with the hot end 16 of the chamber 12 through a conduit 28 leading from the hot end 16 of the chamber 12 to the enclosed chamber 30 of cylinder 26.

Movement of the heat exchanger 14 within the chamber 12 may be controlled by mechanical means such as a shaft 20 which extends through the wall at one end 18 of the chamber 12, being in sliding, fluid tight engagement therewith. At each end of the exchanger 14 there is located a perforated disk 21. These disks 21 hold the heat exchanger material 22 in place and are secured to the inner wall of the exchanger shell. The disks 21 allow free passage of gas through the exchanger 14. The shaft 20 is attached to the disk 21 at the cold end of the chamber 12.

The shaft 20 is connected at a point exterior to the chamber 12 to a working member (not shown) which provides for reciprocation of the shaft 20, thus providing for controlled movement of the heat exchanger 14 between the ends 16, 18 of chamber 12. Alternatively, the heat exchanger 14 may be controlled in such movement by means such as electromagnetic forces outside the chamber 12 which act upon the exchanger 14. Such electromagnetic means could, for example, be in the form of a coil of wire surrounding a portion of the cold end of the cylinder 12, through which is passed an alternating current which acts upon a permanently magnetized exchanger shell, thus causing the exchanger 14 to move from end to end within the cylinder 12. Operation of the heat exchanger 14 is supplemented as necessary by additional heat energy input at the hot end 16 of the chamber 12, with such additional heat energy replacing energy which is removed from the system as work output.

Vaporizing liquid such as water may be added inside the chamber 12 to increase the pressure fluctuation. Such liquid will vaporize when exposed at the hot end 16 and will condense as it is forced into the exchanger 14, when the exchanger 14 moves from the cold end 18 to the hot end 16 of the chamber 12. When the exchanger 14 moves from the hot end 16 to the cold end 18, the droplets of liquid will be forced to the hot end 16 where such droplets will again vaporize.

While the chamber 12 is preferably constructed of a non-ferrous metal, the mid-section of the chamber 12, approximately one-half the total length thereof, may be alternatively constructed of an insulating material, in order to reduce the heat transferred through the walls of the chamber 12.

As the heat exchanger 14 is moved from one end of the chamber 12 to the other, there is produced an increase and a decrease in pressure within the chamber 12. The pressure differential is achieved in a most efficient way due to the action of the internal heat exchanger 14 as it removes energy from the gas within the chamber 12, as exchanger 14 moves from cold end 18 to the hot end 16 position, storing it within the system in the exchanger material 22, creating low pressure in the chamber 12 and then releasing energy to the gas to create high pressure within the chamber 12 as the exchanger 14 moves from the hot end 16 to the cold end 18. Such pressure fluctuations are transmitted to the working piston 24 which, in turn, transmits the output to an operative member (not shown) through piston rod 25.

The gas employed within chamber 12 will preferably have properties including high thermal conductivity, a high coefficient of thermal expansion, low specific heat and low corrosive tendencies. Examples of suitable gases include air, helium, nitrogen and argon. As an example of the gas pressure employed in chamber 12, in one embodiment, the pressure of the gas varies from about 8 psia when the main portion of the gas is at the cold end 18 with the exchanger 14 at the hot end 16, as shown in FIG. 1, and with the operating piston 24 at the top of chamber 30, to about 40 psia when the main portion of the gas is at the hot end 16, with exchanger 14 at the cold end 18 as shown in FIG. 2, and operating piston 24 is at the bottom of chamber 30.

As the thermal engine 10 is operated, in one embodiment, the temperature of the gas will be approximately 200° F. as the gas enters the area of the cold end 18 after passing through the exchanger 14. The surrounding shell of the cold end 18 decreases the temperature of the gas to approximately 100° F. As the gas enters the area of the hot end 16 after passing through the exchanger 14, the temperature of the gas is approximately 600° F. The surrounding shell of the hot end 16 increases the temperature of the gas to approximately 900° F. The external temperatures at the cold 18 and hot 16 ends are approximately 70° F. and 1100° F., respectively in this embodiment.

A suitable heat source is employed at the hot end 16 of the chamber 12 to increase the temperature of the gas from 600° F. to 900° F., prior to expansion of the gas into the operating piston chamber 30. The heat source may be supplied, for example, by the use of jacket 47 of a heat conductive material secured around the circumference of the hot end 16, and with a suitable heated liquid or gas being admitted to the interior of the jacket 47 through valved conduit 49.

In the embodiment as shown in FIG. 3, two cylindrical chambers 32,34 are employed, with each chamber 32,34 containing a respective cylindrical heat exchanger 36,38. The chambers 32,34 have respective hot 40,42 and cold 41,43 ends. The hot ends 40,42 of the respective chambers 32,34 are in fluid communication with a common piston 44 and cylinder 46 arrangement through respective conduits 48,50 which communicate with opposite ends of the cylinder 46. The controlled movement of heat exchangers 36,38 by respective connecting shafts 37,39 or other suitable means allows the pressure within cylinder 46 to be varied so as to operate piston 44 within cylinder 46 in the desired manner. Piston 44 transmits the output to an operative member (not shown) connected to piston 44 for relative movement therewith.

In the embodiment as shown in FIGS. 4 and 5, the enclosed chamber 52 for the heat engine is in the form of a semi-cylinder, including semi-cylindrical wall 64 joined to planar base 53, and with vertical end walls 55,57 which close off the chamber 52 at each end. The planar base 53 is constructed of a highly heat conductive material and is equally divided along the longitudinal center line 54 into hot 56 and ambient 58 temperature sides. A vertical insulating wall 60 is attached to base 53 along the longitudinal centerline 54 thereof and extends generally perpendicularly to the base 53 to separate the hot 56 and cold 58 areas below the chamber 52. Wall 60 should extend a sufficient distance below base 53 to prevent any substantial transfer of heat from the hot end 56 to the cold 58 end of the chamber 52 on the exterior thereof.

Located within the chamber 52 and extending the length thereof is a heat exchanger unit 62 of wedge-shaped cross section, with perforated side walls 66,68 which define the wedge shape being attached along their line of intersection to a rod member 70 which lies along the longitudinal center line 54 of the base 53. Rod member 70 is rotatably mounted to the base 53 by suitable securing means 71,73 located at each end of the base 53. Heat exchanger unit 62 thus extends from the center line 54 of the base 53 to the semi-cylindrical wall 64 of chamber 52, with the exchanger 62 having an end wall 67 attached to the outer ends of walls 66,68. End wall 67 is contiguous to but spaced sufficiently from wall 64 of chamber 52 to allow the heat exchanger 62 to move freely within the chamber 52 as the exchanger 62 is rotated. The rod member 70 extends exteriorly of one end wall 57 of the chamber 52 through a packing sleeve 75 and is connected to a suitable power source (not shown) for controlling the rotation of rod 70 and the attached heat exchanger 62.

The heat exchanger 62 may occupy a space such as, for example, approximately 25% of the volume within the chamber 52 and the perforated side walls 66,68 allow the free flow of gas through the exchanger 62. The exchanger 62 is loosely filled with a suitable foraminous material 69 such as fine copper wire strands similar to that previously described.

Rotation of the rod member 70 through an angle of approximately 140° causes the heat exchanger 62 to move from one side of the chamber 52 to the other, as shown in dashed lines in FIG. 5, forcing gas through the exchanger 62 as it moves. As the heat exchanger 62 is rotated from the hot side 56 to the ambient or cold side 58 of the chamber 52, for example, with the gas traveling freely through the exchanger 62, the high temperature of the exchanger material 69 heats the gas, increasing the temperature and the pressure of the confined gas. Rotation of the heat exchanger 62 from the cold side 58 to the hot side 56, on the other hand, removes heat energy from the gas to the exchanger material 69, resulting in a decrease in temperature and pressure of the confined gas. This pressure variation is relayed by a suitable conduit 72 from the hot end 56 to a working piston 74 and cylinder 76 unit. The output of piston 74 is transmitted to an operative member (not shown) through piston rod 78.

The temperatures and pressures employed in the embodiments of FIGS. 1,2, and 3 may also be employed in the embodiments of FIGS. 4 and 5. The heat source for the hot side 56 of the chamber 52 may, for example, be supplied by the use of a jacket 80 of a heat conductive material secured around the exterior of the hot side 56, and with a suitable heated liquid or gas being admitted to the interior of jacket 80 through valved conduit 82.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed and desired to be secured by Letters Patent is:

1. An internal thermal exchanger engine which provides increased efficiency of heat energy due to recycling of heat energy between a gas and exchanger material within a closed system, comprising: an enclosed chamber of generally uniform cross-section throughout its length and having first and second end portions and with a gas phase fluid enclosed therein; a heat exchanger located within said chamber, said heat exchanger being of a size and shape so as to fit inside the chamber with a close tolerance so that the outer walls of the exchanger are freely slideable in a longitudinal direction within the interior walls of the chamber, said heat exchanger containing a foraminous heat conductive material distributed throughout the entire volume of said heat exchanger, said heat exchanger having perforated end portions which allow said gas phase fluid to pass freely through said heat exchanger as said heat exchanger moves between the first and second end portions of the chamber; means for heating said first end portion of said chamber uniformly over said first end portion; means for operating said heat exchanger between the first and second end portions of the chamber; a working piston and cylinder unit; means for connecting said working piston and cylinder unit in fluid communication with said first end portion of said chamber, so that variations in pressure within said chamber are transmitted exteriorly from said first end portion to said piston; said heating means acting to heat the portion of said gas phase fluid which passes into said working piston and cylinder unit.

2. The engine of claim 1, wherein said chamber comprises a cylinder and wherein said heat exchanger is in the form of a cylindrical member slidingly received in said chamber and having perforated ends which allow the gas phase fluid to pass freely through said heat exchanger.

3. The engine of claim 1, wherein said second end portion is maintained at ambient temperature.

4. The engine of claim 2, wherein said heat exchanger is of a length approximately one-half that of the cylindrical chamber.

5. The engine of claim 1, wherein said foraminous material comprises copper wire screening.

6. The engine of claim 1, further including a vaporizing liquid within the chamber to increase pressure fluctuation.

7. The engine of claim 1, wherein the mid-section of the chamber is constructed of an insulating material.

8. The engine of claim 1, wherein one end of said piston and cylinder unit is in fluid communication with said first end portion of said chamber, and wherein the opposite end of said piston and cylinder unit is in fluid communication with a second thermal engine.

9. A method of operating a thermal engine so as to convert heat energy to mechanical energy, comprising:

(a) moving a heat exchanger in reciprocating motion within an elongated chamber containing a gas phase fluid, wherein said heat exchanger is of lesser length than said chamber and is freely movable lengthwise within said chamber, said heat exchanger being of substantially the same cross-sectional area and shape as that of the interior of said chamber, said heat exchanger containing a foraminous heat conductive material distributed throughout the volume of said heat exchanger and with said heat exchanger having perforated end portions which allow said gas phase fluid to pass freely through said heat exchanger during reciprocation thereof;

(b) applying heat to one end of said chamber so as to heat the gas phase fluid adjacent said one end; and (c) passing said gas phase fluid exteriorly from the heated end of said chamber to a working piston and cylinder unit so that variations in fluid pressure within said chamber are transmitted to said piston.

10. The method of claim 9 wherein the end of said chamber to which heat is applied is maintained at about 1100° F. on the external portion thereof and the other end is maintained at ambient temperature on the external portion.

11. The method of claim 10 wherein a vaporizing liquid is provided within the chamber to increase pressure fluctuation.

12. The method of claim 9 wherein one end of said piston and cylinder unit is in fluid communication with said heated end of the chamber, and wherein the opposite end of said piston and cylinder unit is in fluid communication with a second thermal engine.

13. The method of claim 9 wherein said foraminous material is in the form of copper wire screening.

14. The method of claim 9 wherein heat is applied to said one end of the chamber by the use of a jacket of a heat conductive material secured around the circumference of said heated end, and with a heated fluid being admitted to the interior of the jacket.

* * * * *